US007669515B2

(12) United States Patent
Horikawa et al.

(10) Patent No.: US 7,669,515 B2
(45) Date of Patent: Mar. 2, 2010

(54) MAGNET TYPE RODLESS CYLINDER

(75) Inventors: Akiyoshi Horikawa, Tokyo (JP); Naoki Minowa, Tokyo (JP); Hiroshi Yoshida, Tokyo (JP); Mitsuo Noda, Ichinomiya (JP)

(73) Assignees: Howa Machinery, Ltd., Kiyosu-Shi (JP); Koganei Corporation, Tokyo (JP)

( * ) Notice: Subject to any disclaimer, the term of this patent is extended or adjusted under 35 U.S.C. 154(b) by 338 days.

(21) Appl. No.: 11/886,312

(22) PCT Filed: Nov. 25, 2005

(86) PCT No.: PCT/JP2005/022133

§ 371 (c)(1),
(2), (4) Date: Sep. 14, 2007

(87) PCT Pub. No.: WO2006/098062

PCT Pub. Date: Sep. 21, 2006

(65) Prior Publication Data

US 2008/0141856 A1 Jun. 19, 2008

(30) Foreign Application Priority Data

Mar. 15, 2005 (JP) ..... 2005-073518

(51) Int. Cl.
*F01B 29/08* (2006.01)

(52) U.S. Cl. ..... 92/88; 91/DIG. 4

(58) Field of Classification Search ..... 92/88; 91/DIG. 4

See application file for complete search history.

(56) References Cited

U.S. PATENT DOCUMENTS 3,893,378 A 7/1975 Hewitt
4,754,691 A * 7/1988 Rogerson ..... 91/DIG. 4

FOREIGN PATENT DOCUMENTS

| | | |
|---|---|---|
| JP | 60-172711 | 9/1985 |
| JP | 4-113305 | 10/1992 |
| JP | 4-357310 | 12/1992 |
| JP | 2514499 | 7/1996 |
| JP | 9-217708 | 8/1997 |
| JP | 11-336708 | 12/1999 |

* cited by examiner

*Primary Examiner*—F. Daniel Lopez
(74) *Attorney, Agent, or Firm*—Finnegan, Henderson, Farabow, Garrett & Dunner, L.L.P.

(57) ABSTRACT

A pair of cylinder holes 10 are formed in a cylinder tube 2 in the axial direction, a slit 25 is formed between these cylinder holes, and an iron plate 22 is inserted in the slit covering the whole range of the movement of the pistons 3 in the cylinder holes. Spacers 23 made of a synthetic resin are interposed on both sides of the iron plate 22 to reliably hold the iron plate 22 in the slit 25. The iron plate 22 disposed between the cylinder holes works to decrease the repulsive force acting between the inner magnets 14 of the pistons and produce an attracting force between the iron plate 22 and the inner magnets 14, and a contact surface pressure between the wear rings 9 of the pistons 3 and the wall surfaces of the cylinder holes 10 can be adjusted to a suitable value.

5 Claims, 5 Drawing Sheets

MAGNET TYPE RODLESS CYLINDER

TECHNICAL FIELD

The present invention relates to a magnet-type rodless cylinder having a plurality of cylinder holes in a cylinder tube.

BACKGROUND ART

A magnet-type rodless cylinder provided with cylinder holes formed in a cylinder tube, pistons disposed in the cylinder holes so as to move therein, and a slider disposed on the outer side of the cylinder tube and moves along the outer circumference of the cylinder tube, the pistons and the slider being magnetically coupled together, is known in the art.

In magnet-type rodless cylinders, generally, magnets (inner magnets) are arranged in the pistons and magnets (outer magnets) or magnetic material are arranged on the slider. Due to the attracting forces exerted between these magnets and/or magnetic material, the pistons and the slider are magnetically coupled together, and the slider follows the movement of the pistons.

There is known a magnet-type rodless cylinder having a plurality of cylinder holes and a plurality of pistons, in which all of the pistons are magnetically coupled with a single slider Rodless cylinders have been disclosed, for example, in the following documents A to F.

Document A: JP-UM-A-4-113305

Document B: JP-A-4-357310

Document C: Japanese Utility Model Registration No. 2514499

Document D: JP-A-60-172711

Document E: U.S. Pat. No. 3,893,378

Document F: JP-A-9-217708

Document A discloses a magnet-type rodless cylinder in which the cylinder tube and the pistons are formed in a flat shape in a transverse cross section in order to decrease the size of the device and to increase cylinder thrust.

Document B discloses a magnet-type rodless cylinder in which the cylinder tube and the pistons are formed in an elliptic shape, in an oval shape or in a symmetrically pear shape in a transverse cross section.

Further, document C discloses a magnet-type rodless cylinder in which two cylinder tubes each having a cylinder hole are arranged in parallel, and a single slider is provided so as to surround the pair of cylinder tubes.

Document D relates to a slit-tube-type rodless cylinder. Document D discloses a rodless cylinder in which two cylinder holes are formed in parallel in one cylinder tube with pistons disposed in the cylinder holes so as to move in the axial direction of the cylinders.

In the rodless cylinder of document D, the two pistons are mechanically coupled to a single slider via slits opened in the walls of the cylinder tubes and covered with sealing bands.

Document E also relates to a slit-type-rodless cylinder. Document E discloses a rodless cylinder in which the cylinder tube and the cylinder holes are of a rectangular shape in a transverse cross section, and the pistons are also formed in a rectangular shape in a transverse cross section corresponding to the shape of the cylinder holes.

Document F relates to a rod-type cylinder. The rod-type cylinder is provided with a rod connected to a piston extending in the axial direction, and the movement of the piston is transmitted to an external part of the cylinder tube through the rod. Document F discloses a rod-type cylinder in which two cylinder holes are formed in parallel in a cylinder tube.

FIG. 6 illustrates a magnet-type rodless cylinder 61 disclosed in document C.

The magnet-type rodless cylinder 61 of FIG. 6 has a pair of cylinder tubes 62 arranged in parallel with each other with cylinder tubes coupled and fixed together by end caps 67 provided on both ends of the cylinders.

Further, cylinder holes (not shown) are formed in the cylinder tubes 62, and pistons (not shown) are contained in the cylinder holes.

A slider 64 is disposed on the outer side of the cylinder tube 62 to surround both cylinder tubes 62.

Inner magnets are disposed in the pistons in the cylinder holes and outer magnets are disposed on the inner surface of the slider through which the cylinder tubes pass through. The two pistons and the single slider are magnetically coupled together by the attracting forces between the inner magnets and the outer magnets.

In the magnet-type rodless cylinder 61 of FIG. 6, working fluid such as compressed air is supplied into the cylinder holes in the cylinder tubes through the end caps 67 on both sides, whereby the two pistons move in the cylinder tubes in a synchronized manner. Therefore, the slider integrally coupled to the pistons by magnetic force moves on the outer side of the cylinder tubes following the movement of the pistons.

Generally, in magnet-type cylinders that are now being used, the cylinder tubes and the cylinder holes are of an exactly circular shape in cross section. Therefore, even when internal pressure acts on the tubes, the cross section of the tubes undergoes a uniform deformation (expansion), and stress acting on the tubes is uniform without producing partial deflection or concentration of stress.

However, when cylinder tubes having a flat (non-circular) sectional shape are used as disclosed in documents A and B, the cylinder holes also have a non-circular shape in cross section. Therefore, if internal pressure is excerted by the fluid, the tubes undergo a non-uniform deformation. When cylinder tubes having a non-circular shape in cross section are used, a stress concentration or partial deflection occurs on the tube, and both maximum stress and maximum deflection of the tube may become excessive.

To solve this problem, it is possible to increase the thickness of the tubes to enhance the rigidity of the tubes. If the thickness of the tubes is increased, however, it is necessary to increase the magnetic coupling force coupling the pistons to the slider. In this case, the required magnetic coupling force often is several times greater than the magnetic coupling force when tubes are used having a circular shape in cross section.

Because of this, magnet-type rodless cylinders having cylinder holes of a non-circular shape are difficult to be put into practical use.

On the other hand, the magnet-type rodless cylinders of document C solved the above problem by arranging two cylinder tubes each having an exactly circular shape cross section in parallel.

However, when a plurality of cylinder tubes 62 are used as disclosed in document C, the number of parts used for the magnet-type rodless cylinder increases. This causes an increase in the number of the assembling steps and an increase in the installation space of the cylinders.

Further, if the two cylinder tubes 62 are arranged close to each other in parallel as disclosed in document C, the inner magnets provided in the pistons in the cylinder tubes repel each other, and the pistons receive repulsive forces in an outward direction. Accordingly, the pistons are pushed against the inner walls of the cylinder holes due to the repulsive force, and the friction force between the pistons and the cylinder walls increases with an increase in the pressure of the contact surface between the pistons and cylinder walls. This results in an increase in the minimum operation pressure of the working fluid required for moving the pistons when supplying the working fluid into the cylinder. An increase in the minimum operation pressure of the working fluid causes a problem of decreased durability at various portions of magnet-type rodless cylinders.

DISCLOSURE OF THE INVENTION

In view of the above problems of the related art as described above, an object of the present invention is to provide a practical magnet-type rodless cylinder, which has a plurality of cylinder tubes arranged in parallel with each other and capable of preventing a decrease in durability and thickness (height) of the rodless cylinder as a whole by adjusting the repulsive forces acting between the pistons.

According to an invention as set forth in claim 1, there is provided magnet-type rodless cylinder comprising a cylinder tube made of a nonmagnetic material; pistons disposed in the cylinder holes formed in the cylinder tube so as to move therein in the axial direction of the cylinder tube; a slider made of a nonmagnetic material and is disposed on the outer circumferential surface of the cylinder tube so as to move in the axial direction of the cylinder tube along the outer circumferential surface of the cylinder tube; inner magnets disposed in the pistons and outer magnets or a magnetic material disposed in the slider, the magnetic attracting force acting between the inner magnets and the outer magnet or the magnetic material enable the slider to move following the movements of pistons; wherein the cylinder holes and the pistons are arranged in a plurality of sets in parallel, and a member made of a magnetic material is disposed between at least a pair of neighboring cylinder holes among the cylinder holes along the axial direction of the cylinder holes.

According to an invention as set forth in claim 2, there is provided a magnet-type rodless cylinder in claim 1, wherein the plurality of cylinder holes are formed in the single cylinder tube, and the member made of the magnetic material is arranged in the single cylinder tube.

According to an invention as set forth in claim 3, there is provided a magnet-type rodless cylinder described in claim 1 or 2, wherein the cylinder tube is constituted by connecting a plurality of cylinder tube members each having at least one cylinder hole together, and recessed portions are formed in the connecting portions of the cylinder tube members to accommodate the member made of a magnetic material.

According to an invention as set forth in claim 4, there is provided a magnet-type rodless cylinder in any one of claims 1 to 3, wherein spacers made of a nonmagnetic material are disposed between the member made of a magnetic material and the cylinder holes.

According to an invention as set forth in claim 5, there is provided a magnet-type rodless cylinder in any one of claims 1 to 3, wherein the member made of a magnetic material is formed by using a synthetic resin containing a magnetic metal powder.

In the magnet-type rodless cylinder of claim 1, since a magnetic material member (i.e., a member made of a magnetic material) is disposed between at least one pair of cylinder holes along the axial direction thereof, the repulsive force acting between the pistons is decreased.

Further, an attracting force is produced between the pistons and the magnetic material member. Therefore, balance between the repulsive force and attracting force acting on the pistons can be adjusted by the magnetic material member. According to the present invention, the force pressing the pistons against the wall surfaces of the cylinder holes when the cylinder holes are arranged in parallel can be set to a suitable value, and thereby, an increase in the minimum operation pressure required for the working fluid can be suppressed. Thus, according to the present invention, it is possible to prevent a decrease in the durability of the components of the magnet-type rodless cylinder.

In the magnet-type rodless cylinder of claim 2, since a plurality of cylinder holes are formed in the single cylinder tube, it is possible to decrease the size of the apparatus as a whole as compared to the case where a plurality of cylinder tubes are arranged in parallel.

In this case, the minimum operation pressure required for the working fluid can be relatively suppressed as described above. Therefore, the deformation of the cylinder tube and stress concentration thereon becomes smaller. Thus, it is possible to realize the magnet-type rodless cylinder of a flat shape having a small thickness (height).

In addition since one slider is actuated by a plurality of pistons, the size of the magnet-type rodless cylinder can be smaller while maintaining large cylinder thrust.

Further, in the magnet-type rodless cylinder of claim 3, the cylinder tube is constituted by coupling a plurality of cylinder tube members together. Therefore, a recessed portion for accommodating the magnetic material member can be easily formed. Further, since the cylinder tube member can be easily formed by an extrusion process, an advantage of easily controlling the roughness of the inner surfaces and outer surfaces of the cylinder tube can be achieved.

In the magnet-type rodless cylinder of claim 4, further, the magnetic material member is disposed between the cylinder holes with spacers made of a nonmagnetic material. Therefore, when the magnetic material member is held in, for example, a slit formed in the cylinder tube, the magnetic material member can be reliably held at a suitable position in the slit by adjusting the thickness of the spacers. Further, in this case, the position of the magnetic material member can be precisely adjusted between the cylinder holes by adjusting the thickness of the spacers. This makes it possible to lower the accuracy for machining the slit or the recessed portion for accommodating the magnetic material member, and thereby decrease the machining cost of the magnet-type rodless cylinder.

Further, in the magnet-type rodless cylinder of claim 5, the magnetic material member is formed by using a synthetic resin containing a magnetic metal powder. Therefore, the magnetic material member can be produced easily and at a lower cost.

BEST MODE FOR CARRYING OUT THE INVENTION

An embodiment of the magnet-type rodless cylinder of the invention will now be explained with reference to the attached drawings.

Figure 1:
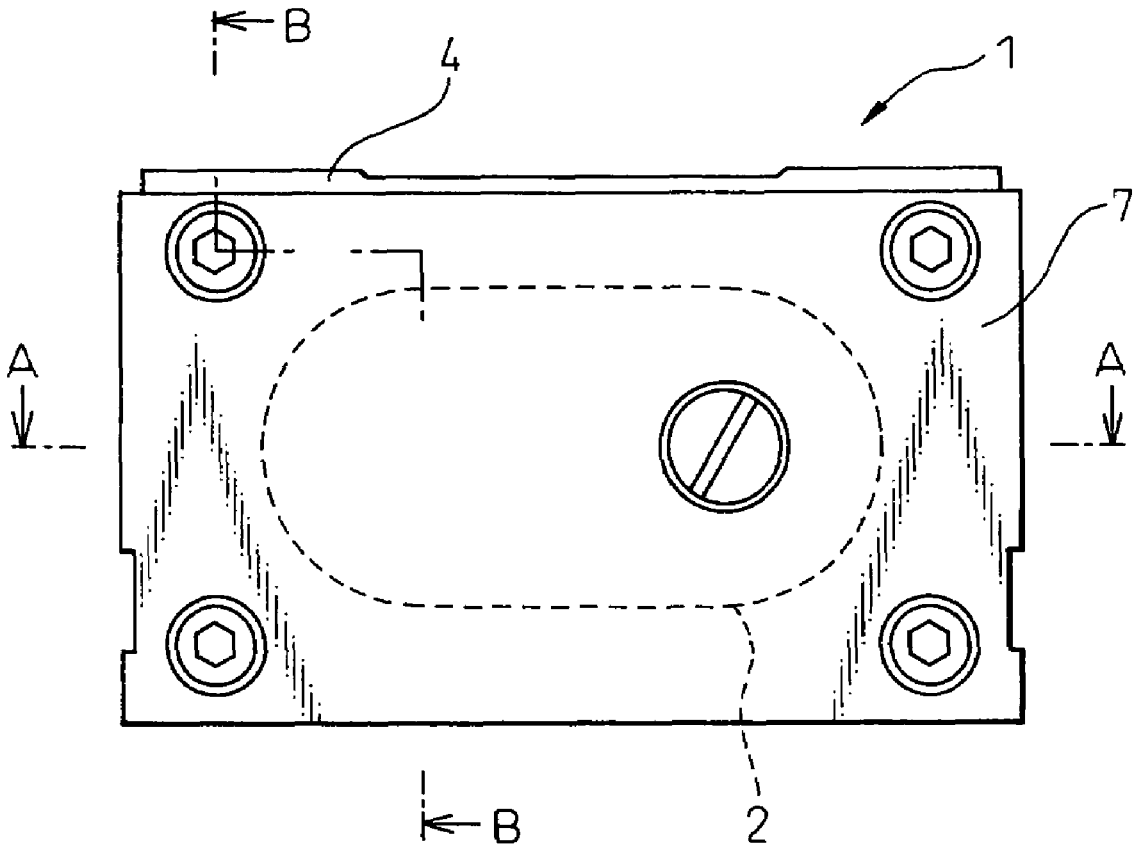
FIG. 1 is a front view of an embodiment of a magnet-type rodless cylinder according to the present invention.
Figure 2:
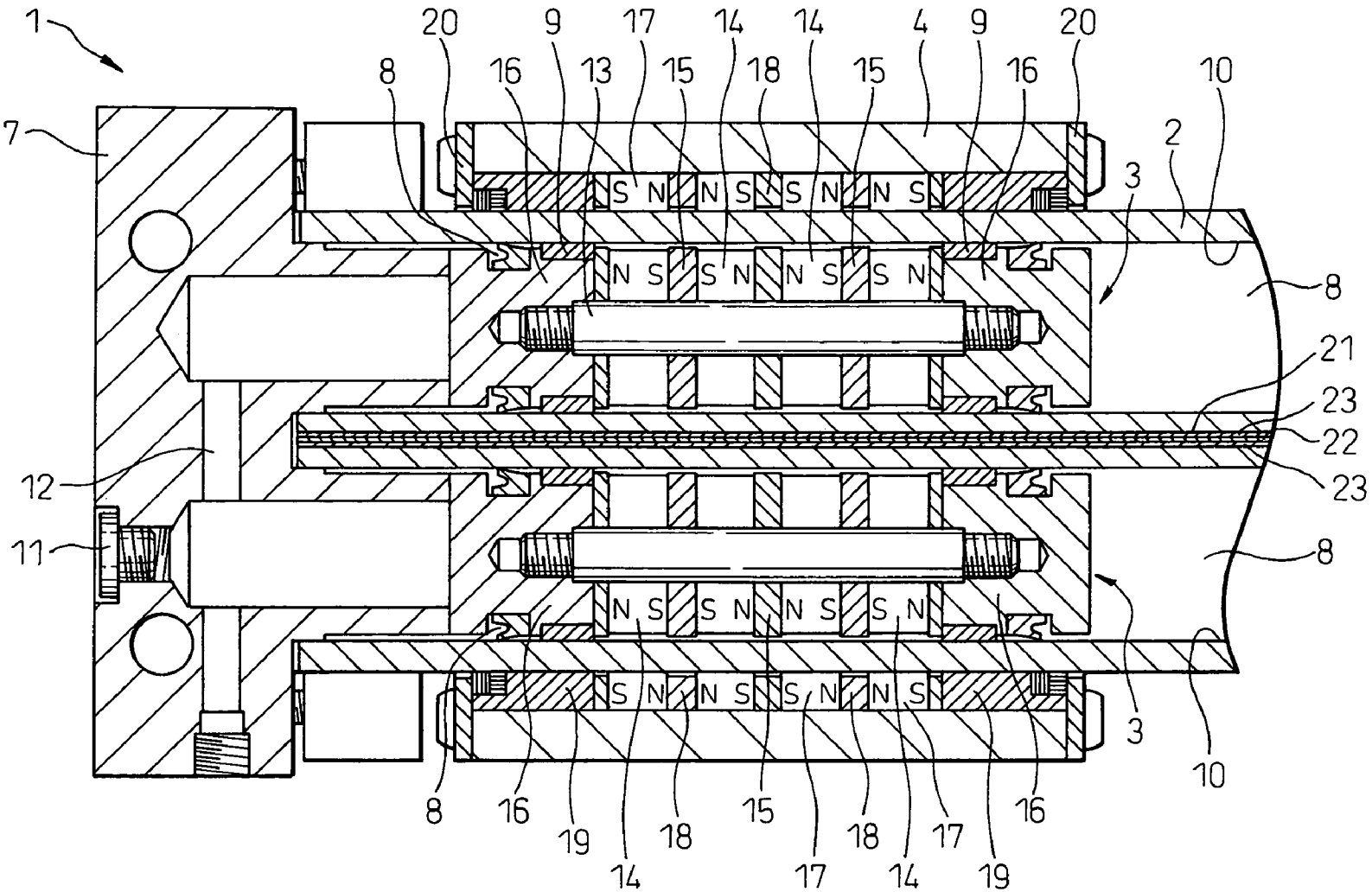
FIG. 2 is a sectional view along line A-A in FIG. 1.
Figure 3:
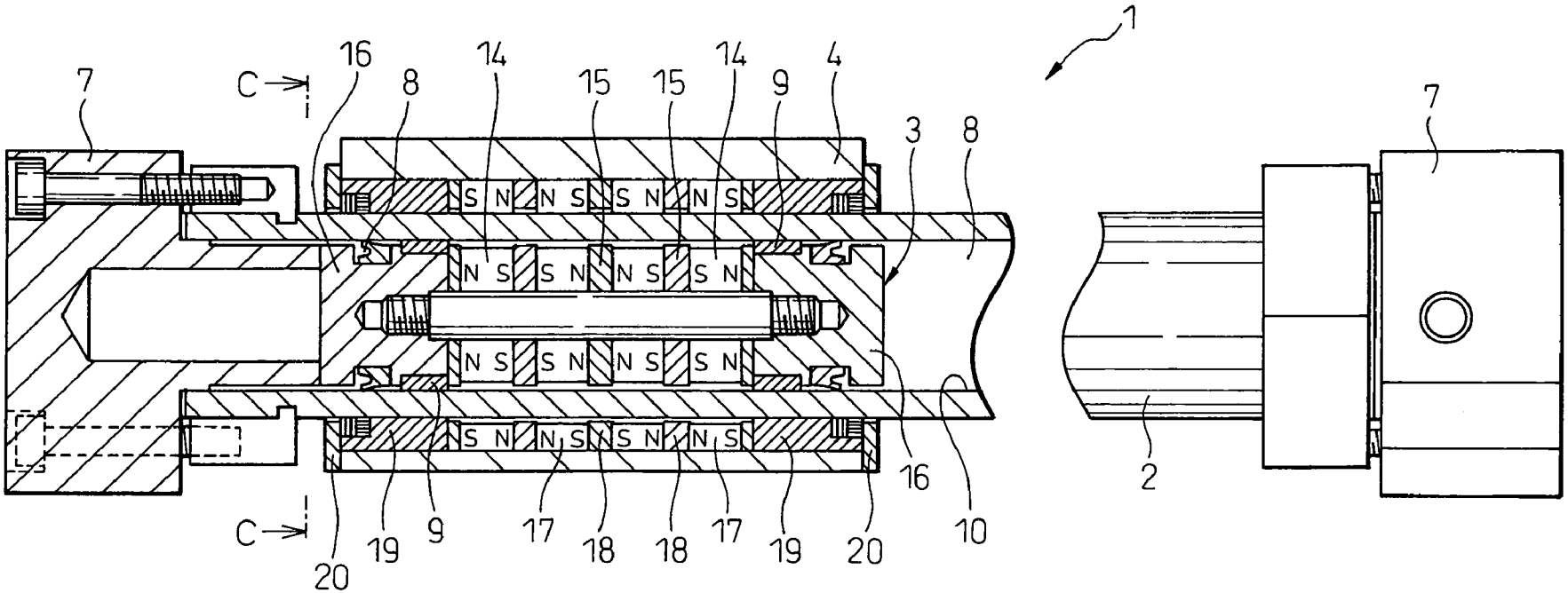
FIG. 3 is a sectional view along line B-B in FIG. 1.
Figure 4:
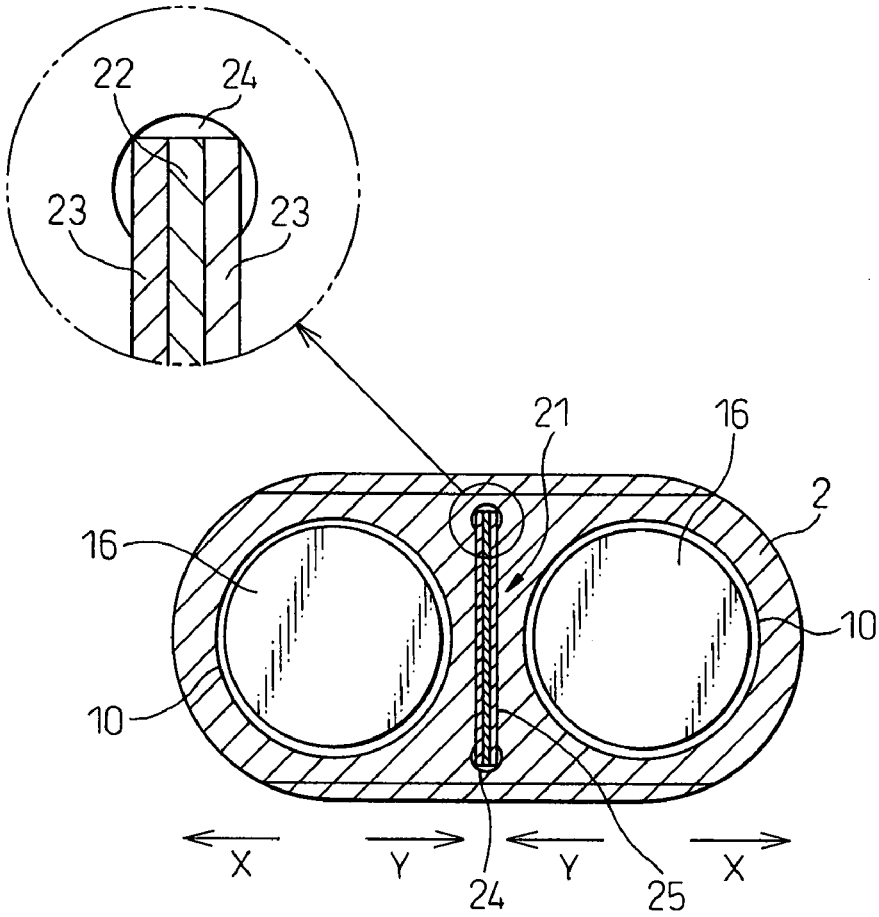
FIG. 4 is a sectional view along line C-C in FIG. 3.

FIG. 1 is a front view of a magnet-type rodless cylinder 1, FIG. 2 is a sectional view along line A-A in FIG. 1, FIG. 3 is a sectional view along line B-B in FIG. 1 and FIG. 4 is a sectional view along line C-C in FIG. 3.

As shown in FIG. 3, the magnet-type rodless cylinder 1 of this embodiment includes a cylinder tube 2 made of a non-magnetic material disposed between end caps 7 and 7. A slider 4 of a rectangular shape in cross section is provided on the outer circumference of the cylinder tube 2 to slide in the axial direction of the cylinder tube 2.

The cylinder tube 2 has a flat elliptic shape in cross section as shown in FIG. 4. The cylinder tube 2 is disposed so that it penetrates through the slider 4, and therefore, the slider 4 is guided along the axis of the cylinder tube 2 while maintaining its horizontal state.

Further, the cylinder tube 2 has formed therein, a pair of cylinder holes 10, 10 of an exactly circular shape in cross section in parallel with each other as shown in FIG. 4.

Each cylinder hole 10 has a piston 3 held therein so as to move in the axial direction of the cylinder tube 2. Each cylinder hole 10 is divided into cylinder chambers 8, 8 by the piston 3.

Each piston 3 is constituted by alternately fitting a plurality of doughnut-like inner magnets 14 and inner yokes 15 onto a central piston shaft 13. Inner wear rings 9 are disposed at both ends of the assembly of the inner magnets 14 and the inner yokes 15. Further, the above assembly is clamped and fastened by piston ends 16 from both outer sides of the inner wear rings 9.

The magnetic poles of the inner magnets 14 are so arranged that the same poles are opposed to each other as NS, SN, NS, SN in the axial direction. Further, the same poles of the inner magnets 14 are opposed to each other between the neighboring pistons 3, 3.

Outer magnets 17 and outer yokes 18 of an oblong doughnut shape are alternately fitted into the penetration portion where the cylinder tube 2 penetrates through the slider 4. That is, the assembly of a plurality of outer magnets 17 and a plurality of outer yokes 18 of the oblong doughnut, which are alternately laminated in the axial direction, is formed in the slider 4 surrounding the circumference of the cylinder tube 2. Outer wear rings 19 are disposed at both ends of the assembly, and the outer magnets 17 and the outer yokes 18 are fixed to the penetration portion for the cylinder tube 2 by the end plates 20 via the outer wear rings 19.

The magnetic poles of the outer magnets 17 are so arranged that the same poles are opposed to each other in the axial direction and that different poles are opposed to each other with respect to the magnetic poles of the inner magnets 14 on the piston 3 as SN, NS, SN, NS. Due to the magnetic attracting forces of these magnets, the two pistons 3, 3 and the slider 4 are magnetically coupled together.

A fluid port 11 and a flow path 12 communicating the fluid port 11 with the cylinder chambers 8, 8 are formed within each end cap 7.

By supplying compressed air into right or left cylinder chambers 8 from the corresponding fluid ports 11,11 and the fluid path 12, the pistons 3, 3 move in the cylinder holes 10 in synchronization with each other.

As described above, the inner magnets 14 of the two pistons 3 are arranged in such a manner that the same poles are opposed to each other between the pistons. Therefore, a force (repulsive magnetic force) acts on the respective pistons 3 in a direction so that the pistons 3 repel each other (X-directions in FIG. 4). Due to the repulsive magnetic force, the respective pistons 3 are pressed against the inner wall surfaces of the cylinder holes 10. Therefore, the friction force increases between the wear rings 9 of the piston 3 and the wall surface 10 of the cylinder hole. This causes a problem of an increased minimum pressure (the minimum operation pressure) of the working fluid supplied into the cylinder chamber 8 for causing the piston 3 to start sliding.

In this embodiment, the above-noted problem is solved by disposing a member 22 made of a magnetic material between cylinder holes 10 and 10.

In this embodiment, a thin iron plate (having a thickness of about 0.1 mm to about 0.3 mm in this embodiment) is used as a member made of a magnetic material (hereinafter referred to as "magnetic material member") 22. In this embodiment, the magnetic material member 22 is disposed between the cylinder holes 10, 10 so that it covers the whole range of the movement of the pistons.

A slit 25 is formed in the cylinder tube 2 at a position between the cylinder holes 10, 10 along the axial direction of the cylinder tube 2 to accommodate the magnetic material member 22.

The magnetic material member 22 is fitted into the slit 25 in such a manner that it is sandwiched by spacers 23 made of a nonmagnetic material (synthetic resin in this embodiment) on both sides. Referring to FIG. 4, round holes 24 of a diameter larger than the width of the slit 25 are formed at the upper end and the lower end of the slit 25. In this embodiment, the magnetic material member 22 and the spacers 23 can be easily inserted into the slit 25 without clearance between the magnetic material member 22 and the walls of the slit after the insertion of the magnetic material member.

In this embodiment, the repulsive force acting between the inner magnets 14 of the pistons 3 is decreased by disposing the magnetic material member 22 between the cylinder holes 10. Further, an attracting force acts between the magnetic material member 22 and the inner magnets in the directions (Y-directions in FIG. 4) opposite to the directions (X-directions in FIG. 4) of the repulsive force. Therefore, it is possible to balance the repulsive force and the attracting force acting on the pistons 3 by adjusting the thickness of the magnetic material member. Thus, the pressure of the contact surface between the wear rings 9 of the pistons 3 and the wall of the cylinder holes 10 can also be adjusted.

As explained above, according to this embodiment, a pair of cylinder holes 10 of an exactly circular shape in cross section are separately formed in the single cylinder tube 2. Therefore, even when the thickness of the cylinder tube 2 is decreased to a value of a practical level, the deflection and stress of the cylinder tube can be kept sufficiently minimum when the internal pressure acts in the cylinder holes. Therefore, it is possible to realize a magnet-type rodless cylinder of a flat-type having a small height (small thickness) without greatly increasing the magnetic coupling force between the pistons and the slider 4. Further, since the slider 4 is driven by a plurality of pistons 3, the driving force of the slider 4 (cylinder thrust) can be easily increased.

In this embodiment, further, a thin iron plate that serves as a magnetic material member 22 is disposed in the cylinder tube 2 between the cylinder holes 10, 10 along the axial direction covering the whole range of motion of the pistons 3. This makes it possible to balance the repulsive force acting between the inner magnets 14 of the pistons 3 and the attracting force acting between the inner magnets 14 and the magnetic material member 22.

Therefore, the pressure of the contact surface between the wear rings 9 of the pistons 3 and the wall surfaces of the cylinder holes 10 can be set to a suitable value, and thereby, an increase in the minimum operation pressure for initiating the movement of the piston, which is caused by an increase in the pressure of the contact surface of the wear rings 9, can be suppressed. According to this embodiment, the durability of the magnet-type rodless cylinder 1 can be improved. In addition, since the minimum operation pressure can be set to be relatively low, the maximum deflection and degree of stress concentration can be kept minimum even if flat cylinder tubes are used.

Further, as shown in FIG. 4, the magnetic material member (e.g., iron plate of a thickness of 0.1 mm to 0.3 mm) is fitted in the slit 25 in such a manner that it is sandwiched by spacers 23 made of a nonmagnetic material in this embodiment.

For example, when the cylinder tube 2 is formed by an extrusion process, it is difficult to form the slit 25 with the width thereof smaller than a certain value (2.0 mm to 3.0 mm). However, since the magnetic material member is held in the slit 25 by using the spacers 23 as described above, the magnetic material member 22 having the width smaller than the width of the slit 25 can be firmly held in the slit 25.

Further, in this case, the position of the magnetic material member 22 can be precisely set between the cylinder holes 10 by adjusting the thickness of the spacers 23 on both sides of the magnetic material member 22. Therefore, even if the accuracy of positioning the slit 25 is low, adjustment of the surface pressure of the piston wear rings 9 is not affected, and thereby the machining cost of the slit can be lowered.

It should be noted that the constitution of the magnet-type rodless cylinder of the present invention is not limited to the above embodiment. The materials, shapes, structures and mounting positions of the cylinder tube, pistons, slider, end caps and the magnetic material member can be suitably changed as required without departing from the spirit and scope of the invention.

For example, although the cylinder tube in the above embodiment is constituted as a single member, the cylinder tube may be assembled from a plurality of parts.

Figure 5:
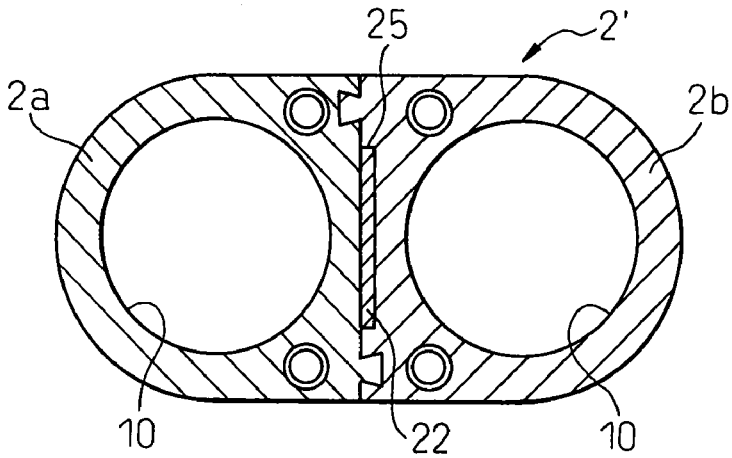
FIG. 5 is a sectional view illustrating a cylinder tube constitution in a magnet-type rodless cylinder different from that of FIG. 1.
Figure 6:
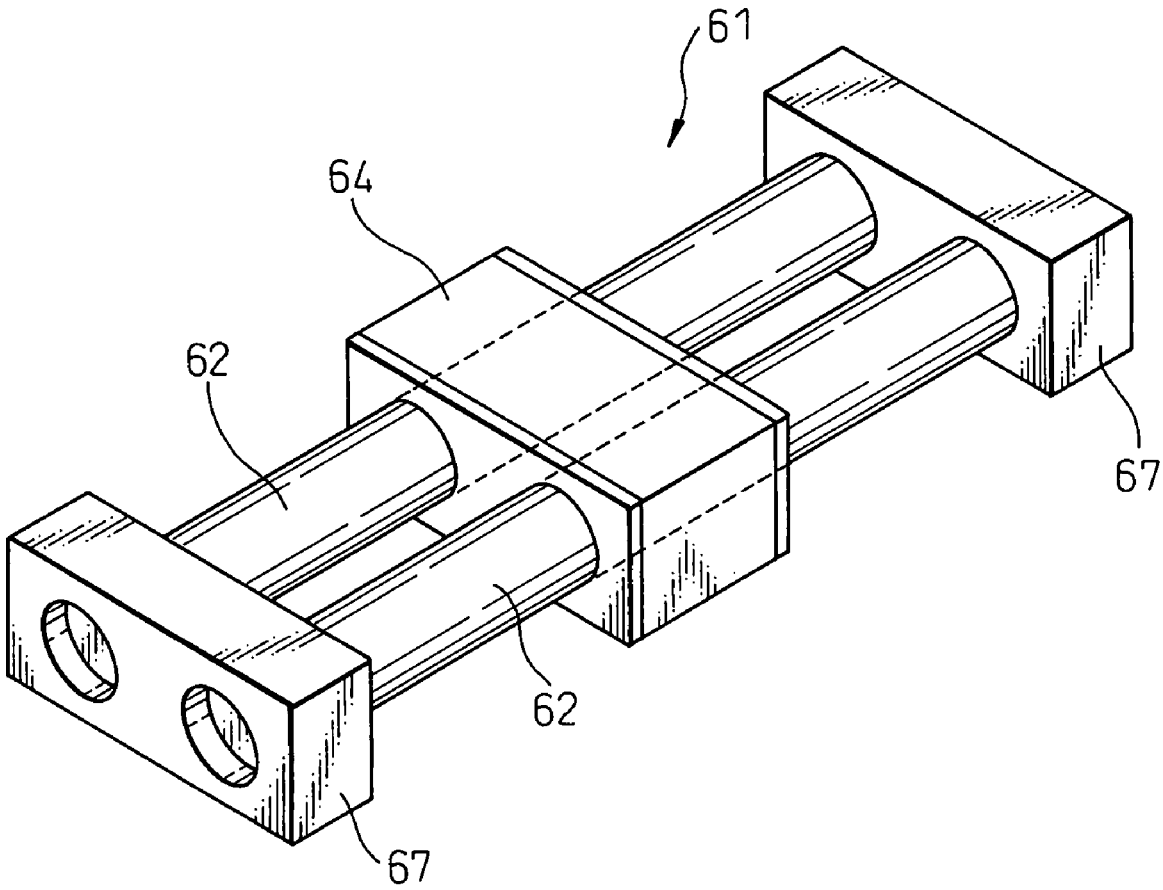
Fig.6 RELATED ART
FIG. 6 is a perspective view illustrating the whole magnet-type rodless cylinder according to a related art.

FIG. 5 is a sectional view illustrating a cylinder tube 2' assembled from a plurality of members. In FIG. 5, the same elements as those of FIGS. 1 to 4 are indicated by the same reference numerals.

Referring to FIG. 5, the cylinder tube 2' is assembled by coupling separately formed cylinder tube members (left member 2*a* and right member 2*b*) together. Cylinder holes 10 are perforated in the left member 2*a* and in the right member 2*b*.

In this embodiment, a recessed portion is formed on the right member 2*b* on the surface to be coupled to the left member 2*a* along the axial direction of the cylinder holes 10. When the right member 2*b* is coupled to the left member 2*a*, the recessed portion works as a slit 25 for holding the magnetic material member 22.

In this case the magnetic material member 22 may be inserted into the slit 25 after the two cylinder tube members 2*a* and 2*b* are coupled together. Alternatively, the cylinder tube members 2*a* and 2*b* may be coupled together in a state where the magnetic material member is placed in the recessed portion of the right member 2*b* prior to coupling the two cylinder tube members 2*a* and 2*b* together.

The left member 2*a* and the right member 2*b* are provided with engaging protuberances and engaging grooves, respectively, and the two members 2*a* and 2*b* are joined together by bringing the engaging protuberances of the one member into engagement with the engaging grooves of the other member.

By using the cylinder tube 2' of the assembled structure as described above, it is possible to separately form the individual cylinder tube members 2*a* and 2*b* by an extrusion process. Therefore, dimensional precision can be improved as compared to when the whole cylinder tube is formed by an extrusion process, and therefore, a slit 25 of a smaller width can be easily formed. Further, in this case, the die used for extrusion process can be easily machined and further advantages of improved surface roughness and the dimensional precision of the inner and outer surfaces of the cylinder tube members 2*a* and 2*b* can be obtained. This makes it possible to form the slit 25 of a small width with precision, and therefore, in this case, the spacers can be omitted.

The above embodiments use an iron plate of a thickness of 0.1 mm to 0.3 mm as the magnetic material member. However, the shape and type of the magnetic material member 22 are not limited to the above embodiments.

As the magnetic material member 22, for example, it is possible to use an iron plate of a thickness larger than the thickness described above. Or, the magnetic material member 22 can be formed by using a metal mesh or a synthetic resin containing a magnetic material powder (e.g., iron powder or the like). Further, the magnetic material member 22 can be constituted by using a magnetic material other than the iron plate.

As the spacers, a material other than the synthetic resin, i.e., a nonmagnetic material such as aluminum or the like can be used.

In the above embodiments, further, a single magnetic material member is disposed between the cylinder holes. However, the number of the magnetic material members disposed between the cylinder holes may be two or more.

When three or more cylinder holes are formed in the cylinder tube, the magnetic material member does not necessarily have to be disposed among all of the cylinder holes.

The above embodiments have explained cases where a plurality of cylinder holes are formed in a single cylinder tube. However, the present invention is also applicable to even a case where a plurality of cylinder tubes are arranged in parallel, each of the plurality of cylinder tubes having a cylinder hole perforated therein.

The invention claimed is:

1. A magnet-type rodless cylinder comprising:

a cylinder tube made of a nonmagnetic material;

pistons disposed in the cylinder holes formed in said cylinder tube so as to move therein in the axial direction of the cylinder tube;

a slider made of a nonmagnetic material and is disposed on the outer circumferential surface of said cylinder tube so as to move in the axial direction of the cylinder tube along the outer circumferential surface of the cylinder tube;

inner magnets disposed in said pistons and outer magnets or a magnetic material disposed in said slider, the magnetic attracting force acting between said inner magnets and said outer magnet or the magnetic material enabling said slider to move following the movements of said pistons;

wherein said cylinder holes and said pistons are arranged in a plurality of sets in parallel, and a member made of a magnetic material is disposed between at least a pair of neighboring cylinder holes among the cylinder holes along the axial direction of the cylinder holes.

2. The magnet-type rodless cylinder according to claim 1, wherein said plurality of cylinder holes are formed in the single cylinder tube, and the member made of said magnetic material is arranged in said single cylinder tube.

3. The magnet-type rodless cylinder according to claim 1, wherein said cylinder tube is constituted by connecting a plurality of cylinder tube members each having at least one cylinder hole together, and recessed portions are formed in the coupling portions of said cylinder tube members to accommodate said member made of a magnetic material.

4. The magnet-type rodless cylinder according to any one of claims 1 to 3, wherein spacers made of a nonmagnetic material are disposed among said member made of a magnetic material and the cylinder holes.

5. The magnet-type rodless cylinder according to any one of claims 1 to 3, wherein said member made of a magnetic material is formed by using a synthetic resin containing a magnetic metal powder.

* * * * *